US006547177B2

(12) United States Patent
Fitzpatrick

(10) Patent No.: US 6,547,177 B2
(45) Date of Patent: Apr. 15, 2003

(54) WINDING DEVICE

(75) Inventor: Martin J. Fitzpatrick, Dublin (IE)

(73) Assignee: Loctite (R&D) Limited, Dublin (IE)

( * ) Notice: Subject to any disclaimer, the term of this patent is extended or adjusted under 35 U.S.C. 154(b) by 28 days.

(21) Appl. No.: 09/777,999

(22) Filed: Feb. 7, 2001

(65) Prior Publication Data

US 2001/0010344 A1 Aug. 2, 2001

(30) Foreign Application Priority Data

Feb. 1, 2000 (EP) ..... 00200384

(51) Int. Cl.[7] ..... B21C 47/14; H01F 41/06

(52) U.S. Cl. ..... 242/439.1; 242/439.3; 242/442

(58) Field of Search ..... 242/439.1, 439.2, 242/439.3, 441, 442, 562.1, 566

(56) References Cited

U.S. PATENT DOCUMENTS

| | | | | | |
|---|---|---|---|---|---|
| 297,610 | A | * | 4/1884 | Logan | 148/580 |
| 750,206 | A | * | 1/1904 | Layne | 140/92.1 |
| 2,746,124 | A | * | 5/1956 | Beleck | 242/439.3 |
| 2,863,610 | A | * | 12/1958 | Chambers et al. | 242/439.3 |
| 3,095,640 | A | * | 7/1963 | Butterworth et al. | 140/124 |
| 3,315,917 | A | * | 4/1967 | Brown | 242/128 |
| 3,716,080 | A | * | 2/1973 | Scaddan et al. | 140/124 |
| 3,756,522 | A | * | 9/1973 | Ackerman | 242/439.3 |
| 3,931,839 | A | * | 1/1976 | Burman | 140/124 |
| 4,012,273 | A | | 3/1977 | Inka | 156/490 |
| 4,153,990 | A | * | 5/1979 | Kamimura | 140/124 |
| 4,189,111 | A | | 2/1980 | Doiron | |
| 4,418,875 | A | * | 12/1983 | Brine | 140/124 |
| 4,425,948 | A | * | 1/1984 | Sterner | 140/119 |
| 4,462,551 | A | * | 7/1984 | Bloch | 242/129.3 |
| 4,603,457 | A | * | 8/1986 | Lechner et al. | 140/124 |
| 5,044,573 | A | * | 9/1991 | LeCompte | 102/504 |
| 5,076,510 | A | * | 12/1991 | Norlander | 242/375 |
| 6,098,911 | A | * | 8/2000 | Sheldon | 242/423.1 |
| 6,179,240 | B1 | * | 1/2001 | Todd | 242/129.53 |
| 6,234,420 | B1 | * | 5/2001 | Vetne et al. | 242/419 |
| 6,272,455 | B1 | * | 8/2001 | Hoshen et al. | 704/1 |

FOREIGN PATENT DOCUMENTS

| | | | |
|---|---|---|---|
| DE | 29 00 446 | 8/1979 | B65H/81/00 |
| DE | 2900446 | 8/1979 | B65H/54/02 |
| DE | 11 29 197 | 6/1987 | H01B/2/22 |
| GB | 1007799 | 10/1965 | B60C/21/06 |
| GB | 1194903 | 11/1967 | D05B/91/00 |
| GB | 1264796 | 5/1969 | D05B/91/00 |
| GB | 1276782 | 6/1972 | D05B/97/02 |
| WO | WO 98/47805 | 10/1998 | B65H/49/08 |

* cited by examiner

*Primary Examiner*—Emmanuel Marcelo
(74) *Attorney, Agent, or Firm*—Steven C. Bauman

(57) ABSTRACT

A device for winding pipe sealant filamentary materials onto a pipe comprising: (a) a retainer for retaining a length of filamentary material; and (b) an elongate dispensing aid projecting from said retainer, the dispensing aid comprising at least one guide located at a position spaced from the retainer and through which the filamentary material passes. The material is for sealing threaded pipe joints. The device may be motorized for rotational motion, for example by attachment to a power tool. The device may also have a locating portion for engaging an end of a pipe to which the filamentary material is to be applied. The locating portion may act as an automatic adjuster of the position of the device. Relative rotation of the dispensing aid and the automatic adjuster actuates the automatic adjuster. The device allows for ease of application of pipe sealant material to pipes and may be hand-held.

29 Claims, 6 Drawing Sheets

WINDING DEVICE

FIELD OF THE INVENTION

The present application relates to a winding device or tool. In particular the present application is directed to a device for winding filamentary materials, for example for the application of pipe sealant material to a pipe.

BRIEF DESCRIPTION OF RELATED TECHNOLOGY

Sealing materials are known. Such materials include materials for sealing threaded pipe joints, particularly for use in the plumbing industry for making joints in pipes for water-supply, water-discharge, heating and the like, but also having utility for other types of pipework e.g. in industrial plants.

It is well known for plumbers to use a two-part system of hemp fibre and paste for sealing threaded pipe fittings. Dry hemp fibre is usually supplied in loose unwoven form, and a quantity is taken and drawn out into a length. Hemp is also available in the form of a hank wound on a spool which can be held in a dispenser with a tubular dispensing guide for the hemp. In either case, a length of hemp is wrapped around the threaded area of a male pipe fitting. The paste may be applied to the fitting first, in which case the hemp is drawn through the paste as it is wrapped around the fitting, or alternatively (or in addition) the paste is applied over the hemp. The paste keeps the hemp in place on the male threaded fitting. The female threaded fitting is then applied and completes the joint. The joint can be adjusted later, if desired.

An alternative two-part system is available using polypropylene fibre instead of hemp.

Another commercially available sealing material is a polytetrafluoroethylene (PTFE) tape which is non-fibrous in nature. It is typically about 10 mm wide and 0.25–0.5 mm thick. In use, the tape is wound around the threaded area of a male fitting, with a number of overlaps used to build up a thickness as desired. The female threaded part is then applied to complete the assembly.

Georg Fischer Rohrverbindungstechnik GmbH of D-78224 Singen, Germany, offers for sale a product called PARALIQ PM 35 VLIES which comprises a tape in the form of a synthetic special web, fleece or gauze saturated with a thread sealing paste. It is fibrous in nature like hemp and can be used without either hemp or a separate paste. The tape is 16 mm wide.

U.S. Pat. No. 4,012,273 (Inka) discloses a hand tool for wrapping an unsintered polytetrafluoroethylene tape around the end region of threads on a pipe. The device has a turret for selecting a grooved roller to be used. There are three grooved rollers, the number of grooves per axial inch of the roller differing from one another, each roller being adapted to co-operate with a range of differently pitched threads. The pipe end is partially inserted in the device from the side so as to correctly position the pipe for application of the tape. A grooved roller is selected using the turret and the tape is pressed across the threads and into the grooves on the end of the pipe using the grooved roller. The device appears cumbersome and relatively complex, requiring the use of three rollers. It is not suited for use with pipe sealant materials other than tapes, as each grooved roller is designed only to push a tape into the grooves of the pipe threads. Furthermore the selected grooved roller and the pipe threads must mate correctly to allow the device to operate. The pipe is held against rotation while the entire device circulates about the longitudinal axis of the pipe. In use, in the only working position of the device, the transverse axis of the device is parallel to the longitudinal axis of the device, in other words the longitudinal axis of the device is perpendicular (at 90°) to the longitudinal axis of the pipe.

WO 98/47805 discloses a material for sealing threaded pipe joints comprising a yarn ready-coated with a joint sealing composition. The yarn described is a multifilament yarn which may be applied to a substrate with particular ease by the winding device of the present invention.

WO 98/47805 also discloses a dispenser for dispensing the pipe sealant yarn. The dispenser comprises a hollow body, a cap portion having a dispensing aperture therein and a lid for closing over the aperture when the dispenser is not being used. The cap portion has a blade for cutting and holding the yarn at a desired position.

Notwithstanding the ease of application achieved by the dispenser of WO 98/47805 it would be desirable to provide a winding device which allowed efficient and easy winding of dispensed filamentary pipe sealant material onto a substrate, in particular onto a pipe joint.

SUMMARY OF THE INVENTION

The present invention provides a device for guiding and dispensing filamentary materials (usually for sealing threaded pipe joints onto a threaded pipe joint on an end of a pipe) onto a substrate. The device includes (a) a retainer for retaining a length of filamentary material; and (b) an elongate dispensing aid projecting from said retainer, the dispensing aid comprising at least one guide located at a position spaced from the retainer, and through which the filamentary material passes.

The dispensing aid guides and dispenses the filamentary material through a path from the retainer onto the substrate (usually a pipe joint).

In this arrangement the dispensing aid and the retainer are arranged so that in use for dispensing of the filamentary material the retainer may be located forwardly of the end of the pipe (and the guide is located alongside the pipe joint).

The term "filamentary material" as used herein includes a tape, thread, fibre or yarn and the term "filamentary pipe sealant material" includes a tape, thread, fibre or yarn coated or impregnated with a pipe sealant or otherwise having pipe sealant characteristics. The winding device is most useful in applying materials for sealing threaded pipe joints to the joint to be sealed. The term 'pipe' as used herein to refer to the substrates on which the device of the present invention operates includes threaded portions of pipes and often referred to as pipe joints and also plumbing fittings such as pipe couplings used to join pipes.

The dispensing aid is arranged so that in use a longitudinal axis of at least a portion of the dispensing aid is arranged to move about a longitudinal axis of a pipe, so that the angle between the longitudinal axis of the (portion of the) dispensing aid and the longitudinal axis of the pipe is less than 90°.

The substrate may desirably have a cylindrical surface to which the filamentary material is to be applied. Suitably the filamentary material is for sealing threaded pipe joints. The winding device of the present invention allows for ease of application of filamentary material and in particular of pipe sealing material. Application can be carried out quickly and efficiently, and without the use of rollers. The winding device is designed to be operable by one hand and may suitably be of dimensions and a shape which allow it to be easily held in one hand. While the winding device of the present invention is very useful for dispensing the coated multifilament yarn of WO 98/47805 (the entire contents of which, and of its US equivalent, are hereby incorporated by reference) it will be appreciated that the device may be used with any type of filamentary material such as those described above under the heading "Brief Description of Related Technology". The particular usefulness of the winding device of the present invention for the coated multifilament yarn of WO 98/47805 is that it allows for ease of application of the filamentary material in a desired position on the pipe joint, i.e., in the well(s) or grooves between adjacent screw threads. While it will be appreciated that dispensing any material onto the threads of a pipe may include some degree of riding of the filamentary material across screw threads, it is desirable that at least a portion of the filamentary material is dispensed into the wells between adjacent threads. Filamentary materials which have a width dimensioned to fit between adjacent screw threads are dispensed well by the device of the invention. Typically such materials have a width of less than or equal to about 0.4 cm, usually less than or equal to about 0.3 cm and most have a width of less than or equal to about 0.2 cm. However, it will be appreciated that the winding device of the invention can be used to deploy many different types of pipe sealant material such as hemp, tapes and the like, although as described above, these materials tend to bridge a number of screw threads rather than fit directly into the well between adjacent screw threads.

Suitably the angle between the longitudinal axis of the dispensing aid and the longitudinal axis of at least a portion of the pipe is less than about 85°, such as less than about 80°, more particularly less than about 75°. The longitudinal axis of at least a portion of the dispensing aid may be parallel to the longitudinal axis of the pipe in winding use of the device. Where the entire dispensing aid is straight along its length the entire dispensing aid may be arranged as discussed. Indeed any suitable angle less than 90° can be used.

The device can be supplied as an attachment, for example as an attachment suitable for attaching to a container of the filamentary material. Alternatively the device can be supplied as an integral part of a container for the filamentary material.

In one embodiment the retainer is adapted to hold a container in which the filamentary material is located. This allows the present inventive device to be used with existing containers. In this embodiment it is desirable that the retainer and container are shaped so as to allow ease of attachment of the device to the container. For example the device and the container may be adapted for snap-fit engagement. This is a particularly useful and speedy method of attaching the device to the container. Alternatively the device could have a seat into which the container fits. Any suitable mechanism for attachment of the device to the container may be used.

Suitably the filamentary material is wound about itself in the container, for example in the form of a coil. The term "coil" as used herein refers to a length of material wound or looped upon itself or about a spool and the like. The winding or looping may be in a single direction, for example clockwise or anticlockwise, so that each wind or loop is generally located about a central axis. This allows for ease of dispensing of the material. Alternatively the filamentary material could be wound upon itself in more than one direction so that for example it may be wound into a ball, such as is commonplace for wools and such-like material.

In one embodiment which allows for ease of dispensing, the filament guide is offset from the centre of the device allowing the filamentary material to be dispensed in a circular (concentric) manner by movement of the device. Particularly efficient winding may be achieved using this embodiment.

The guide may comprise an opening, or eye, through which the filamentary material passes. This simple arrangement allows for accurate dispensing.

In an alternative embodiment the dispensing aid has a hollow portion through which the filamentary material passes, and the guide is formed by a mouth at the end of the hollow portion, the mouth being spaced from the retainer.

In one desirable construction a cut-and-hold blade is provided on the dispensing aid for cutting the filamentary material at a suitable place and holding the material for the next use. This allows for quick and convenient cutting of the material and its convenient location for the next use. Suitably the blade is located on, or close to, the guide. Suitably the cut-and-hold blade is positioned on the guide between the retainer and a free end of the dispensing aid. Suitably the cutting edge(s) of the cut-and-hold blade face toward the retainer, allowing for use of one's single hand to cut the filamentary material. In one arrangement the cut-and-hold blade is located on the free end of the dispensing aid. For example the cut-and-hold blade may be formed as a v-shaped notch in the free end of the dispensing aid. The blade may also be integrally formed with the guide.

In an alternative arrangement the dispensing aid includes an elongate body with a channel defined therein along a longitudinal axis and the guide formed by a mouth at the end of the channel. The cut-and-hold blade may be located on a dispensing end of the dispensing aid or on the guide.

It should be noted that the guide may be circular in cross-section or of any suitable shape though shown in the figures as circular in cross-section. Suitable shapes include oval, triangular, rectangular and square cross-sections. Furthermore the guide need not be continuous in cross-section.

In one arrangement where the filamentary material is arranged about a substantially central coil axis the guide is located at an off-centre position on the device for example offset from the coil axis of the coiled filamentary material so that the material may be wound about the pipe. This arrangement reduces the possibility that the material may entangle with itself.

The dispensing aid and/or the guide may be mounted for rotational motion on the retainer. Part or all of the retainer may rotate with the dispensing aid and/or the guide. For example part of the retainer could be arranged to rotate on the rest of the retainer. These latter two embodiments are particularly suited for motorisation.

The winding device may be operated by a motor. Rotational motion of the entire device or of part of the device such as the dispensing aid may be motorised. The entire or part of the device may thus be adapted for rotational motion. In one desirable embodiment the device further includes a spindle for attachment to the chuck of a power tool. The power tool is suitably an electric drill, screwdriver and the like, having a power operated rotating member, whether or not powered by electricity supplied through an electric cord. In one simple embodiment the device further includes an integral power source for powering rotation of the dispensing aid.

In one arrangement the device further includes a locating portion which extends from the retainer in the same general direction as the dispensing aid, and for engaging an end of a pipe to which the filamentary material is to be applied. This allows for ease of location of the device relative to the pipe. This embodiment is particularly suited to motorisation. The locating portion is arranged so that engagement of the end of the pipe positions the dispensing aid so that it projects alongside the pipe.

Suitably the locating portion engages the internal bore of the pipe to which material is to be applied. The locating portion may be stepped or tapered, for example conical or frusto-conical in shape, to allow snug engagement within pipe bores of differing internal dimensions.

In an alternative arrangement the locating portion engages the exterior of the pipe, for example the locating portion may comprise a hood or cowl which is dimensioned to receive (one end of) the pipe. This embodiment also has the advantage of assisting relative positioning of the pipe and the dispensing aid.

The locating portion may be adjustable so as to allow positioning of the guide at different positions relative to the pipe (joint). The locating portion may be arranged for biased movement, for example the locating portion may be spring-loaded.

Suitably the winding device further includes an automatic adjuster for regulating the position of the dispensing aid relative to a pipe to which the filamentary material is to be applied. In one simple construction the locating portion also acts as the automatic adjuster. In one embodiment relative rotation of the dispensing aid and the automatic adjuster, actuates the automatic adjuster.

The present invention also relates to an article of commerce or a system including a container and integral winding device of the present invention. In particular the present invention provides a dispenser which comprises:

(a) a retainer for retaining a length of filamentary pipe sealant material the retainer comprising a container for holding the filamentary material; and (b) an elongate dispensing aid projecting from said container, the dispensing aid comprising at least one guide located at a position spaced from the container and through which the filamentary material passes.

The dispensing aid guides and dispenses the filamentary material through a path from the container onto a substrate.

DETAILED DESCRIPTION OF THE INVENTION

A detailed description of certain embodiments of the present invention will now be described with reference to the accompanying drawings.

Figure 1:
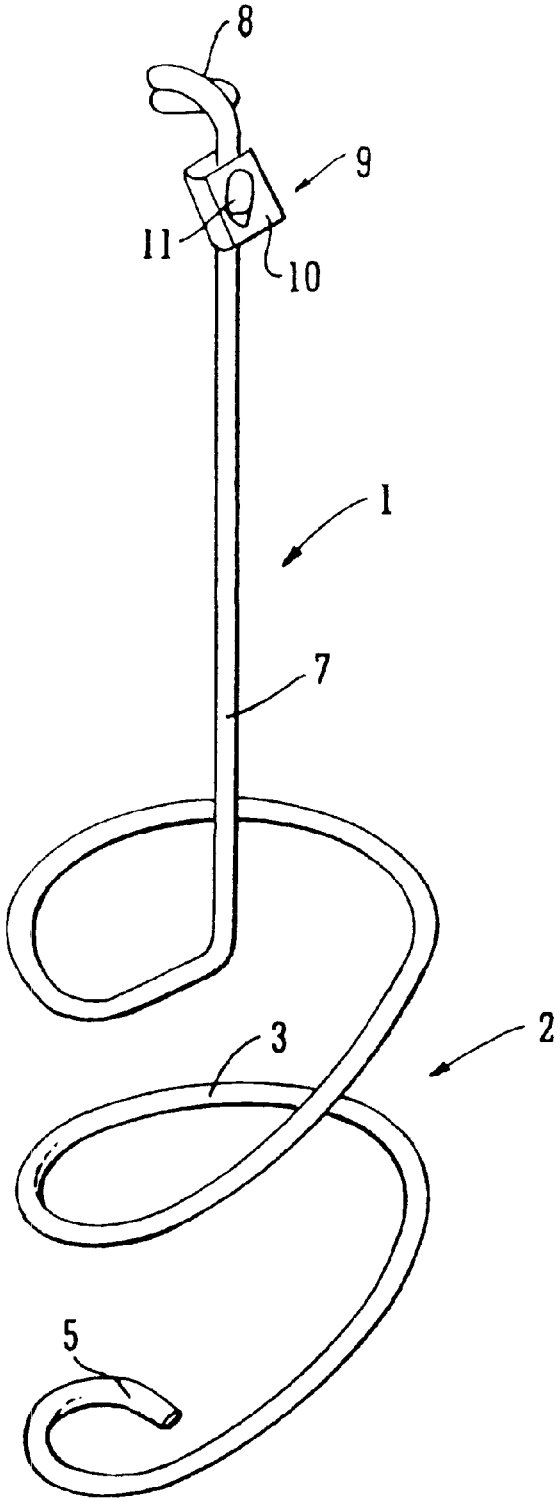
FIG. 1 is a perspective view of a winding device of the present invention.
Figure 2:
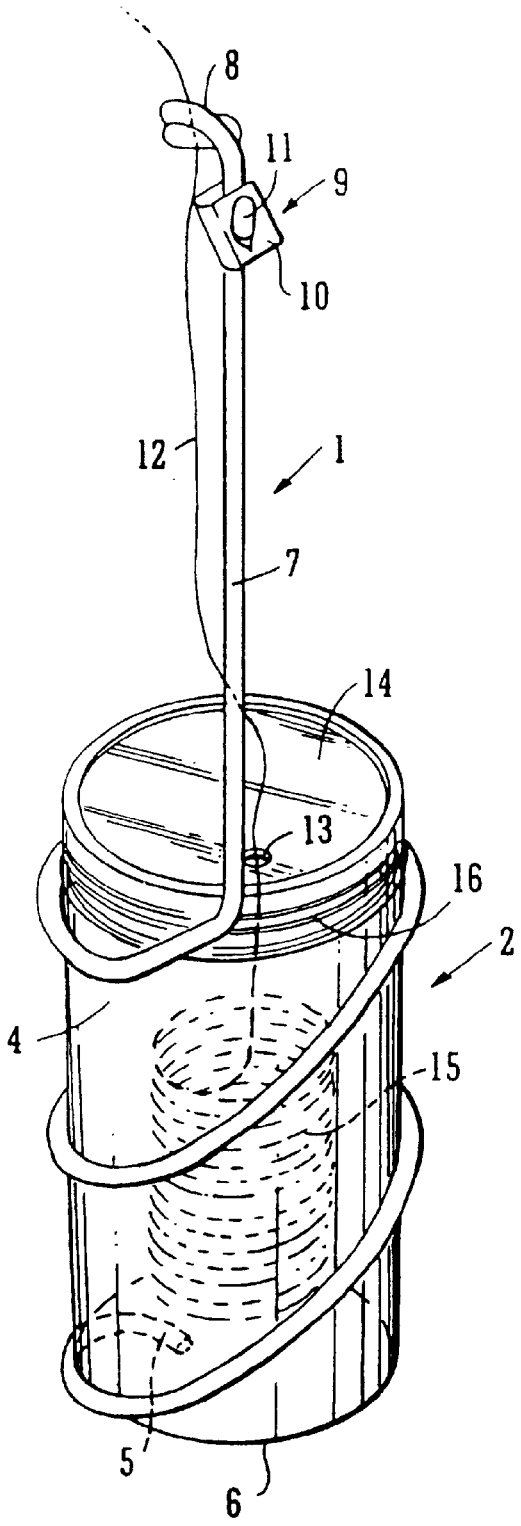
FIG. 2 is a perspective view of the winding device of FIG. 1 with a container containing a coil of filamentary pipe sealant material attached thereto.

FIG. 1 shows a winding device or tool generally designated as 1. The winding device comprises a retainer generally designated as 2. The retainer 2 is formed by a helical part of a wire 3. The helical part of the wire 3 is generally shaped so as to accommodate and retain a container 4 as shown in FIG. 2.

The lower end of the helical wire 3 terminates in an angled portion 5 which protrudes into the generally cylindrical area defined by the helical wire 3 and forms a stop against which the base 6 of the container 4 abuts. The container 4 is a snug fit within the helical retainer 2 and is securely held in the position shown in FIG. 2. In the embodiment the retainer 2 forms a seat for the container 4.

The winding device 1 also comprises an elongate dispensing aid 7 projecting from the retainer 2. The elongate dispensing aid 7 takes the form of an arm projecting from the retainer 2. In the embodiment shown the elongate dispensing aid 7 is formed by the same helical wire 3 as the retainer 2. The elongate dispensing aid 7 has a guide in the form of an eye 8. The eye 8 is spaced from retainer 2 by any suitable distance, such as a distance of about 9.0 cm, and it is located on the elongate dispensing aid 7 at the end distal to the retainer. The eye 8 is also formed from the same wire 3 as the retainer 2 and the elongate dispensing aid 7.

Also located on the elongate dispensing aid 7 near to the eye 8 is a cut-and-hold blade assembly generally designated as 9 comprising a metal clip 10 having an angled upraised surface 11. The upraised surface 11 has sharp (cutting) edges. Snagging the filamentary pipe sealant material 12 between the upraised surface 11 and the clip 10 and tugging thereon causes the sharp edges of the upraised surface 11 to cut the filamentary material 12 at a desired position and to hold the material 11 in place for the next use. This process will be described in more detail below with reference to FIGS. 10 and 11.

Figure 1A:
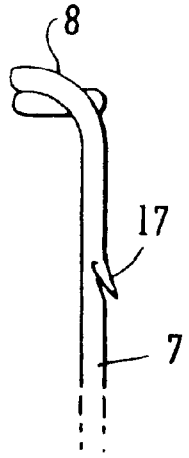
FIG. 1*a* shows part of a winding device of generally similar construction to that of FIG. 1 but with an alternative (integral) cut-and-hold blade.

FIG. 1*a* shows an alternative device to that of FIG. 1. In this embodiment the cut-and-hold blade 17 is integrally formed on the dispensing aid 7. It will be noted from both FIG. 1 and FIG. 1*a* that the cutting edges of both blades 11 and 17 face back toward the retainer. This allows for one-handed operation of the cut-and-hold action.

The assembled winding device 1 and container 4 is shown in FIG. 2. The filamentary material in the embodiment shown in this and the other drawings is the multifilament yarn ready-coated with a joint sealing composition as described in WO 98/47805, although the invention is not limited thereto.

The yarn 12 has been passed through an aperture 13 in the top wall 14 of the container 4. The container 4 has screw threads 16 for engaging a protective lid if desired. From FIG. 2 it can be seen that the yarn 12 is arranged in a loop or coil 15 within the container 4. The axis of coiling is substantially parallel to the elongate dispensing aid 7. However it will be noted that the elongate dispensing aid 7 is off-set (being located to one side, on the exterior of the container 4) from the axis of the coil 15. This allows for ease of winding of the filament about the pipe joint. This offset position is particularly useful for the embodiments of FIGS. 3–9 (described below) which are motorised. The dispensing aid may however be centred on the device or indeed placed at any desired location as the desired wrapping action may be achieved by wrist/arm action.

In this embodiment the device is arranged so that movement of the guide about the pipe is achieved by positioning the retainer forwardly of the end of the pipe with the dispensing aid and guide projecting alongside the device. This elongate (longitudinal) axis of the device is thus substantially aligned with, or substantially parallel to, the longitudinal axis of the pipe. Wrapping of the material about the pipe may be achieved by movement of the device about the longitudinal axis of the pipe. It will be appreciated that there is no necessity for the device to rotate about its own longitudinal axis. However, in common with later embodiments of the invention the longitudinal axis of the dispensing aid moves about the longitudinal axis of the pipe at an angle of less than 90° to the longitudinal axis of the pipe.

It is desirable in all embodiments of the present invention that the longitudinal axis of the pipe, the longitudinal axis of the device and the longitudinal axis of a portion of, or the entire dispensing aid are all arranged to lie in the same general direction for example all parallel or within about 10° to about 30° such as within about 20° from parallel. In the embodiment described above the embodiments below, the dispensing aid and guide direct the material from a position forwardly of the end of the pipe to a position alongside the pipe. On exiting the guide the material is at a position where it turns radially inwardly (toward the pipe).

Figure 3:
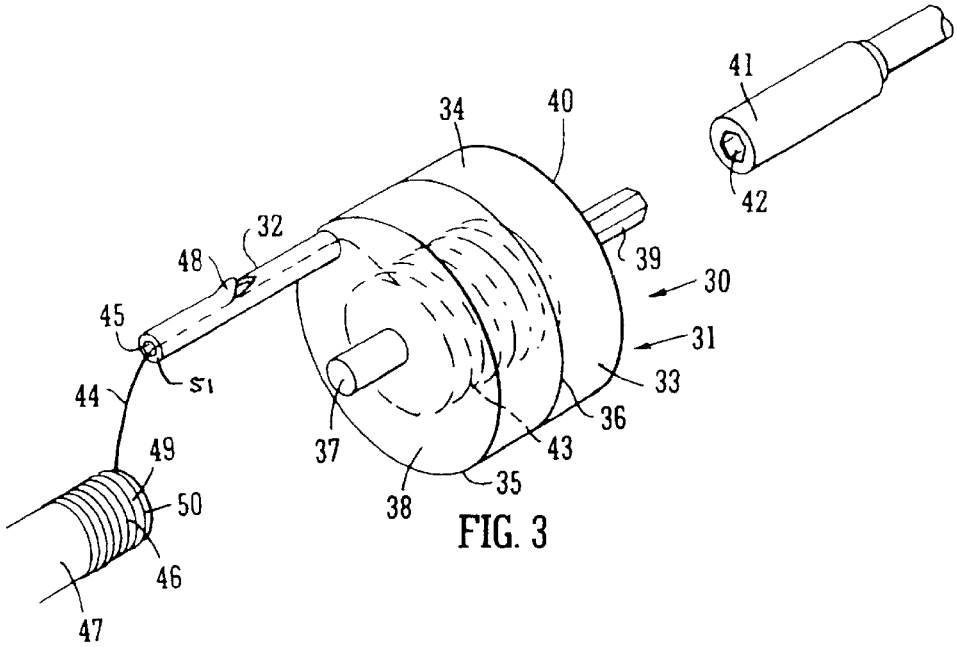
FIG. 3 is a perspective view of an alternative winding device of the present invention which is adapted for attachment to a power tool.

A version of the winding device of the present invention which is suitable for use with a power tool is shown in FIG. 3. In this embodiment the winding device 30 comprises a retainer 31 having an elongate dispensing aid or nozzle 32 projecting therefrom. In this embodiment (and as shown in of FIGS. 4–9) the dispensing aid has a hollow portion, more particularly an elongate channel 45 through which the yarn passes, the guide being formed by a mouth 51 at the end of the hollow portion (the elongate channel). The guide is spaced from the retainer in each embodiment of the present invention. In FIG. 3 the dispensing aid is formed of an elongate body with a channel 45 defined therein. The guide is formed by a mouth 41 at the (dispensing) end of the dispensing aid 32. The retainer 31 generally takes the form of a container 33 generally comprising a hollow body. The container 33 comprises two parts, a base part 34, and an upper part 35. The base part 34 and upper part 35 snap-fit together along joint 36 to form the body which is generally cylindrical in shape. The yarn can be easily placed within the container 33 by separating the base part 34 and upper part 35 as required.

The elongate dispensing aid 32 is formed as a unitary piece with the upper part 35 of the container 33. A locating portion 37 projects from the top wall of the container 33 and is generally centrally aligned thereon. The locating portion 37 takes the form of a cylindrical pin. The locating portion may be of any desired size and suitably has a circular cross-section at the point of engagement with the pipe.

A spindle 39 is located on, and projects from, the base wall 40 of the container 33. The spindle 39 is also centrally aligned on the container 33 and is adapted to be received in a chuck or power shaft 41 of a power tool by means of engagement in a spindle engaging aperture 42 in the chuck 41. It will be appreciated that any suitable means for attachment of the winding device to the power tool may be used for this and other embodiments of the invention. The winding device thus acts as a dispensing hub for the yarn. The power tool is suitably a cordless power tool.

In the embodiment of FIG. 3 (and the later embodiments of FIGS. 4 to 9) the dispensing aid is moved so that a longitudinal axis of the dispensing aid moves about the longitudinal axis of the pipe at an angle to each other of less than 90° such as less than about 85° typically less than about 80° particularly less than about 75°. In FIGS. 4 to 9 the movement of the longitudinal axis of the dispensing aid about the longitudinal axis of the pipe is achieved by rotation of the winding device about its longitudinal axis. In FIGS. 4 to 9 the dispensing aid is straight along its length and is arranged so that in use it is parallel to the pipe. It will be appreciated that the dispensing aid could be angled or curved along its length, for example L-shaped.

A coil 43 of the yarn 44 is located within the container 33. As can be seen in FIG. 3 the yarn 44 has been fed through a longitudinal channel 45 in the elongate dispensing aid 32. The yarn 44 passes through the elongate dispensing aid 32 and as shown in the figure is dispensed onto a threaded end 46 of a pipe 47. In particular the yarn is dispensed into wells 49 between adjacent screw threads 50. A cut-and-hold blade 48 is also located on the dispensing aid 32. The blade assembly 48 may be used to snag and cut the yarn 44 at the appropriate time in the manner referred to previously and as outlined below. It will be noted the cutting edge(s) of the blade 48 face toward the retainer 31 as for the embodiments of FIGS. 1 and 1*a*.

Figure 4:
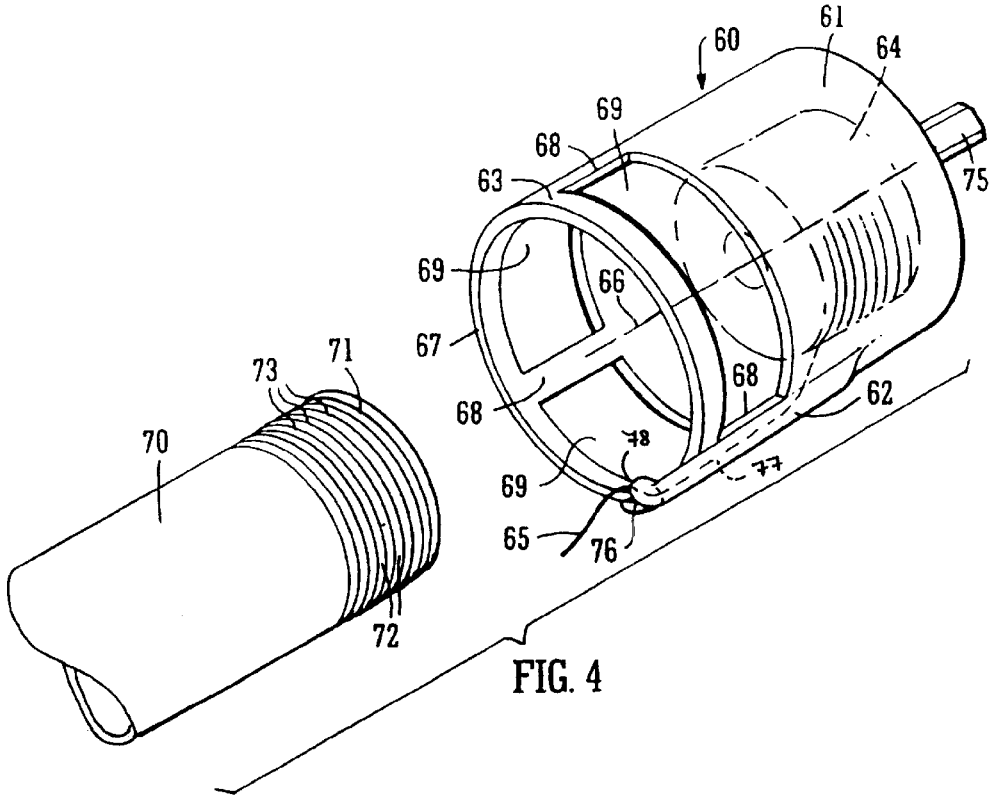
FIG. 4 is a perspective view of an alternative winding device of the invention adapted to be powered by a power tool.

FIG. 4 shows a further alternative winding device 60. The winding device 60 comprises a retainer 61. An elongate dispensing aid or nozzle 62 extends from the retainer 61. A locating portion in the form of a hood or cowl 63 is also formed on the retainer 61. The retainer 61, dispensing aid 62 and cowl 63 are all formed as a unitary piece. A coil 64 of a yarn 65 is retained within the retainer 61. The coil may be wound onto a spool if desired. The coil 64 has a coil axis 66 which is generally centred in the winding device.

The cowl 63 is formed by a ring or rim 67 generally of circular shape and of approximately equal diameter to the retainer 61. It will be appreciated however that the retainer 61 and the cowl 63 may be of any suitable relative dimensions. The rim 67 is located on the retainer 61 by three upstanding members in the form of legs 68. Three windows 69 are formed in the respective spaces between adjacent legs 68, the cowl 63 and the retainer 61. Providing at least one window allows the operator to view the pipe without needing to remove the device from its operating position. As can be seen in FIG. 4 the elongate dispensing aid 62 runs along the exterior of the cowl 63 at a position coincident with one of the legs 68 and extends beyond this rim 67, the end portion of the dispensing aid being turned radially inwardly so that the mouth 78 of a channel 77 therein (the mouth 78 forming the guide for the filamentary material) opens radially inwardly and is aligned substantially with the adjacent leg 68. It will be appreciated that the cowl (for example the adjacent leg 68) and the dispensing aid 62 could be formed of a single unitary piece.

As also seen clearly in FIG. 4 the dispensing aid 62 is offset from the axis of the retainer 61. In particular the dispensing aid 62 extends generally parallel to the coil axis 66. On rotation of the winding device 60 the dispensing aid 62 moves concentrically to the coil axis 66.

A portion of a pipe 70 having an externally-threaded end 71 is also shown in FIG. 4. This pipe 70 (in common with the pipe shown for other embodiments) is the male part which is to be fitted together with an internally-threaded female part to form a pipe joint. The cowl 63 is designed to fit over the pipe 70 to engage the exterior thereof, to allow for dispensing of the filament 65 onto the threaded end 71 of the pipe 70, and in particular into the wells 72 formed between adjacent threads 73. A spindle 75 is provided on the base of the retainer 61 for attachment to a power tool as described for FIG. 3 above. A cut-and-hold blade is integrally formed on the free end of the dispensing aid 62 in the form of sharp cutting edges of a v-shaped notch 76, in the end of the dispensing aid 62 at the periphery of the mouth 78 and thus on the guide. When dispensing of the yarn 65 is complete it may be snagged within the notch 76, thereby cut, and the end of the yarn is held for the next use.

Figure 5:
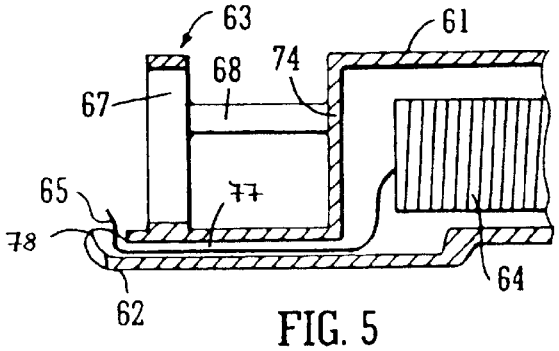
FIG. 5 is a part-sectional view of the winding device of FIG. 4, and containing a filamentary pipe sealant material.

A cross-sectional view of the device of FIG. 4 is shown in FIG. 5. The rim 67 is shown supported by legs 68 on the retainer 61. The coil 64 of yarn 65 is also shown. The path of the yarn 65 can be clearly seen passing from the coil 64 through the central longitudinal channel in the dispensing aid 62. As can be seen in FIG. 5 the retainer 61 has a top wall or cap portion 74 which aids retention of the coil 64 in the retainer 61.

Figure 7:
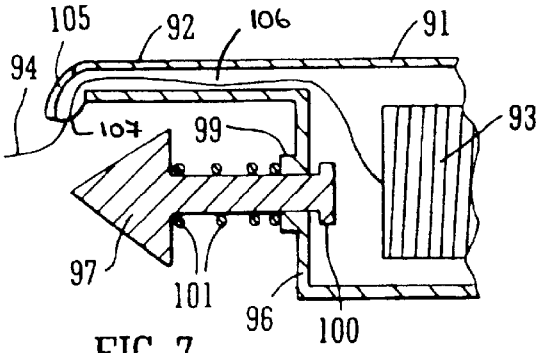
FIG. 7 is a cross-sectional view of part of the winding device of FIG. 6.
Figure 6:
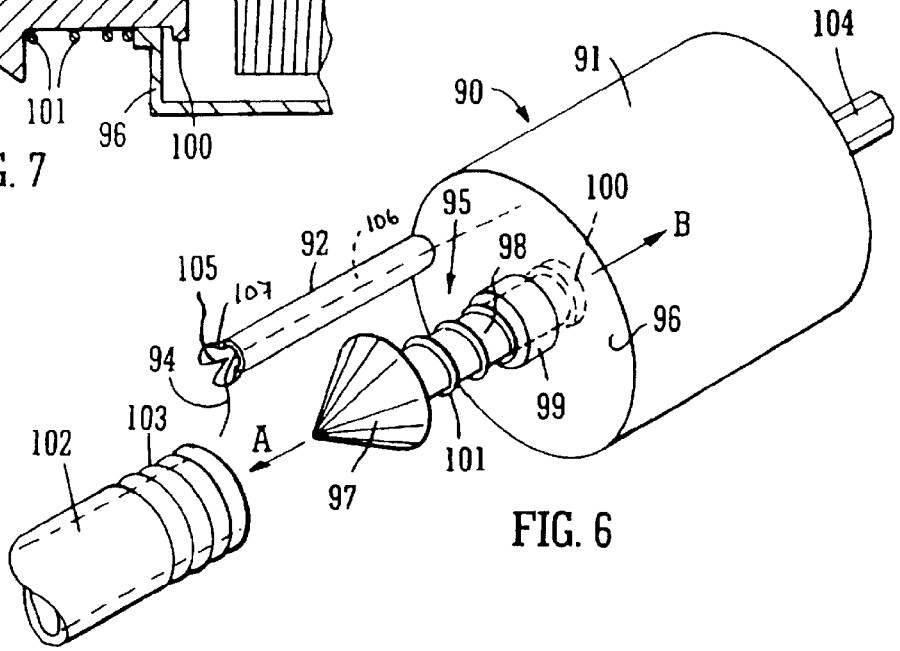
FIG. 6 is a further alternative winding device of the present invention.

FIG. 6 shows a further alternative embodiment of the present invention. A winding device 90 comprises a retainer in the form of cylindrical container body 91 and an elongate dispensing aid or nozzle 92 projecting therefrom. As seen more clearly from the cross-sectional view of FIG. 7, the container body 91 holds a coil 93 of a multifilament yarn 94 coated with pipe sealant material. The embodiment shown in FIGS. 6 and 7 is similar to the embodiment of FIG. 3 and functions in a similar manner. In the embodiment of FIGS. 6 and 7 a locating portion generally designated as 95 is arranged centrally on a top wall 96 of the container body 91. The locating portion is arranged centrally on the container body, projecting therefrom in the same direction as the dispensing aid and substantially parallel to it. The locating portion 95 has a head or engaging portion 97 which is conical in shape for engaging the internal bore of a pipe. It will be appreciated that the head 97 may be of any suitable shape.

The conical head 97 is located on one end of a shaft 98. The shaft 98 is slidingly held to the container 91 by a collar or bearing 99. The shaft 98 is free to rotate. A circumferential stop 100 on the end of the shaft 98 prevents the locating portion 95 from moving too far forward (in the direction of the arrow A) while the conical head 97 prevents the locating portion 95 from falling into the container body 91. The locating portion 95 is biased by a biasing means in the form of a (helical) spring 101 located between the conical head 97 and the container body 91. In the embodiment shown the conical head 97 is spring loaded, being generally biased in the direction of the arrow A. Relative (longitudinal) movement of the conical head 97 and the container body 91 will cause compression of the spring 101 allowing movement of the locating portion 95 in the direction of the arrow B. The device of FIGS. 6 and 7 has a spindle 104 attached to the container 91 which allows operation by a power tool as described above.

In use the conical head 97 is aligned with the interior bore of a pipe 102. The winding device 90 can then be used to apply the yarn 94 to the wells between adjacent threads of an externally-threaded pipe 103 as described previously. Applying pressure on the winding device 90 in the direction of the arrow A causes relative movement of the conical head 97 and the container body 91 as described above. Applying progressive pressure therefore will allow the locating element 95 to control application of the yarn 94 from the dispensing aid 92 as the dispensing aid 92 moves with the container body 91. It is possible to progressively control the amount by which the dispensing aid projects alongside the pipe, while the retainer remains forwardly of the pipe end. Application of the yarn into successive wells between successive adjacent screw threads on the pipe is thus possible in a continuous manner.

The dispensing aid 92, has at its free end, a cut-and-hold blade in the form of the sharp edges of a v-shaped notch 105 formed in its end. The notch 105 may be used to snag and cut the yarn 94 at the appropriate time. It will also hold the yarn 94 for the next use. As for the embodiment of FIGS. 4 and 5 the dispensing aid 92 has a channel 106 defined therein. The guide is formed by a mouth 107 of the channel 106. The guide is spaced from the retainer.

Figure 8:
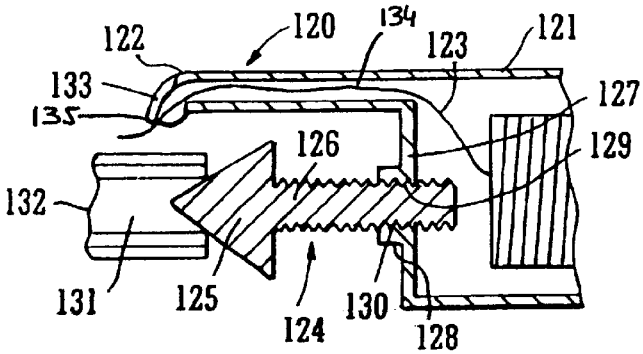
FIG. 8 is a cross-sectional view of part of a yet further embodiment of the winding device of the present invention.

A further alternative embodiment is shown in cross-section in FIG. 8. FIG. 8 shows a winding device 120 comprising a retainer 121 (only part of which is shown) and a dispensing aid or nozzle 122. A coated yarn 123 is threaded through the winding tool as described for previous embodiments. The guide is formed by a mouth 135 at the end of the channel 134.

In this embodiment the locating means generally denoted as 124 comprises a conical head 125 mounted on a locating shaft 126. The locating shaft 126 is held in a top wall 127 by a collar 128. The shaft 126 has a screw thread portion 129 which engages in the reciprocal screw threads 130 on the collar 128. The retainer 121 and the locating portion 124 thus each have (reciprocal) inter-engaging formations which provide for relative (rotational and longitudinal) movement of the filament dispenser 122 and the container 121. In use as shown in FIG. 8 the conical head 125 is engaged in the bore 131 of a pipe 132. Relative rotation of the filament dispenser 122 and the locating portion 124 then takes place either by manual or motorised actuation as described previously. Relative rotation of the filament dispenser 122 relative to locating portion 124 causes relative movement of the conical head 125 and the retainer 121, due to the inter-engagement of the screw threads 129 on the shaft 126 and screw threads 130 on the collar 128. In this embodiment therefore relative rotation of the locating portion and the retainer can be used to vary the distance between the locating portion 124 and the retainer 121 which in turn can be used to control the location of the dispensing aid 122 relative to the pipe 132. In use rotation of the dispensing aid 122 in a selected direction is used to progressively wrap the filamentary material about the pipe 132. The dispensing aid 122 creeps forward due to action of the screw threads causing each successive winding of filamentary material to be put down on a screw thread adjacent to the last on which the filamentary material was applied. In this way the filamentary material is automatically wound about the pipe threads in a satisfactory manner and may be applied into the wells between adjacent screw threads as described previously. The device of FIG. 8 has a cut-and-hold blade which is generally in the form of the cutting edges of a v-shaped notch 133 in the (dispensing) end of the dispensing aid 132. A spindle or other means may be attached to the device 120 to allow for motorised rotation.

It will be appreciated that in all the embodiments of the present invention described, the action of the dispensing aid may be motorised optionally with an integral motor and power source. The power source could alternatively be an external power source.

Figure 9:
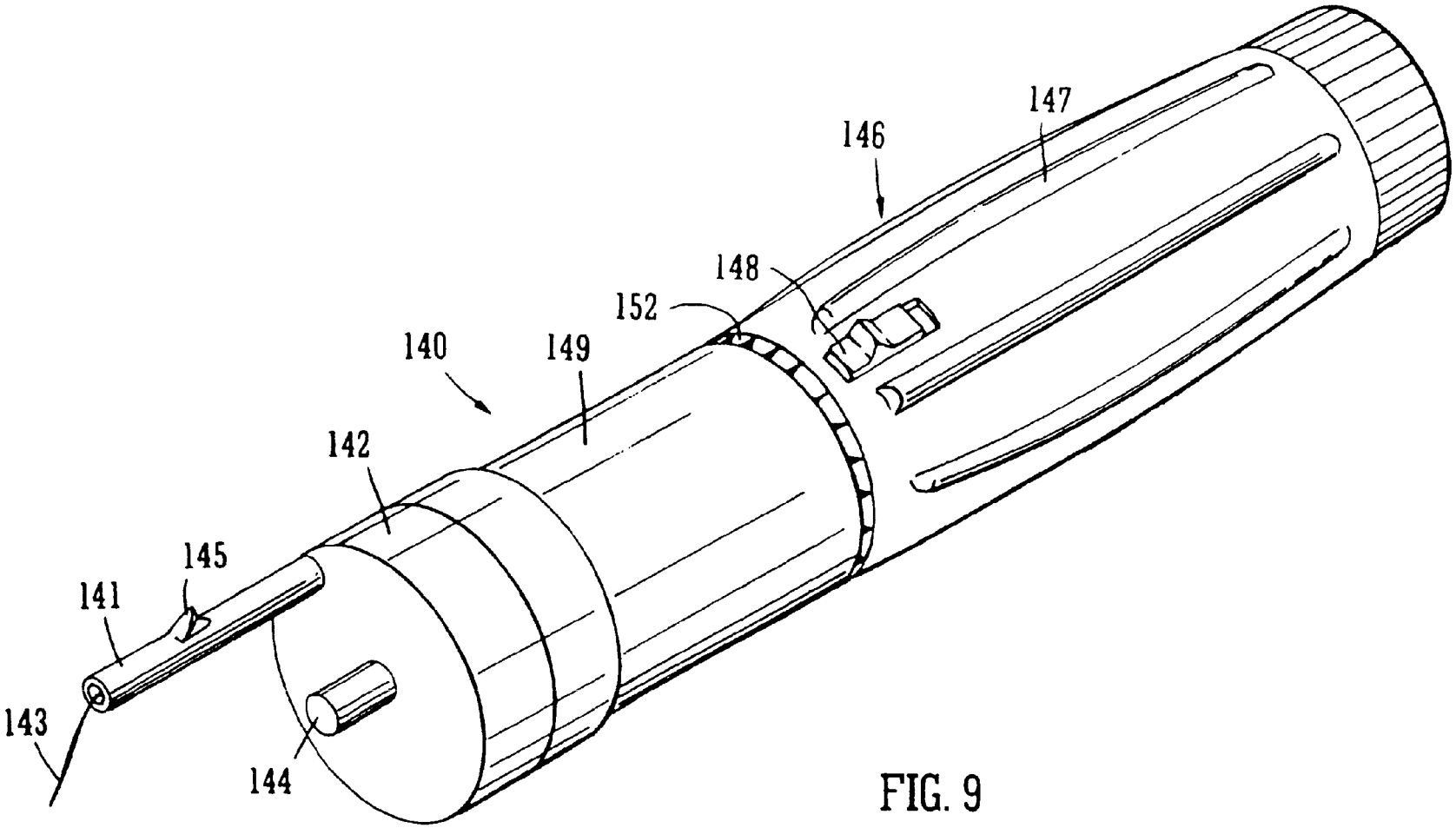
FIG. 9 shows a perspective view of an even further alternative embodiment of the present invention having an integral power source.

A winding device 140 is shown in FIG. 9, which is powered by an integral source and may be hand-held.

In particular the device 140 has an elongate dispensing aid 141 mounted on a retainer 142 and projecting therefrom. The retainer 142 holds a yarn 143. The device 140 also has a locating portion in the form of a nose 144 on the retainer 142 and a cut-and-hold blade 145. These features all operate in a manner similar to that described for the corresponding features of the devices shown in the earlier Figures.

The device 140 has a handle portion 146 with grips 147 to allow ease of manual gripping. The handle portion 146 is fitted with a switch 148 for activating a motor held within a central portion 149 of the device. The motor (powered by an integral source) powers the rotational motion of the dispensing aid 141 and the retainer 142. The central portion 149 and the handle portion 146 screw apart about joint 152. If batteries are used they can be loaded into a suitable compartment in the handle portion 146.

The handle portion 146 holds the power pack, which may be a battery or other electrical storage means. Alternatively the device 140 could be adapted to use mains electricity.

Figure 10:
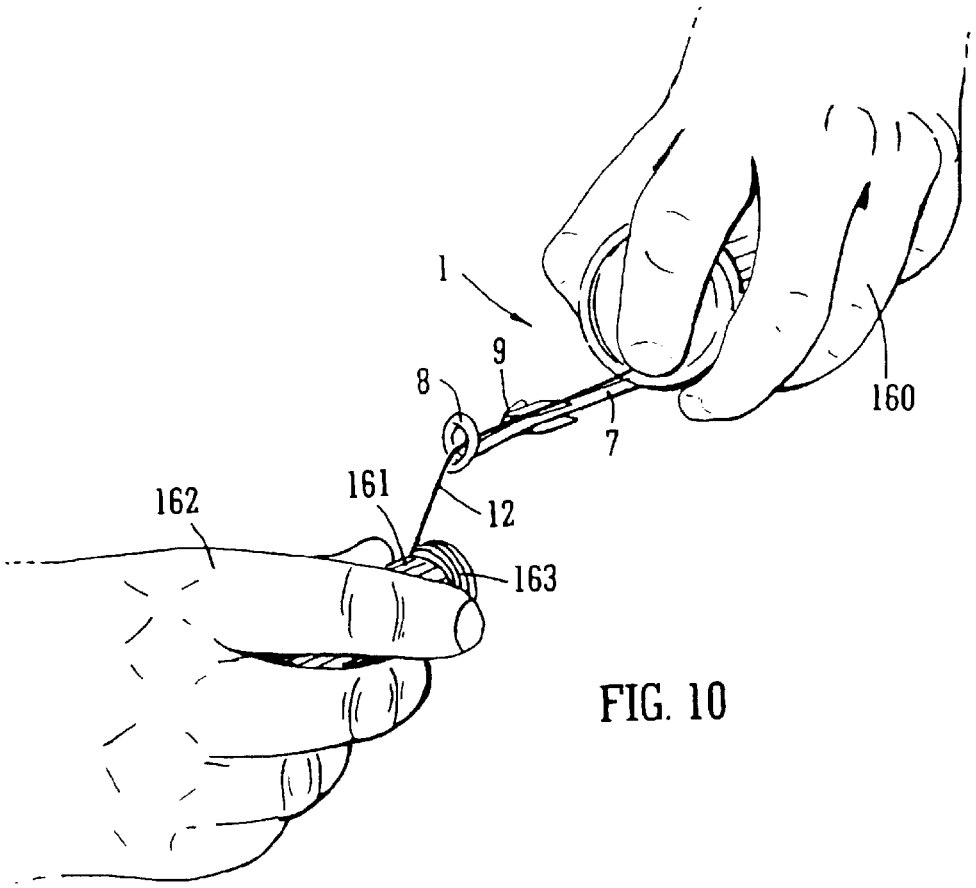
FIG. 10 is a perspective view of the device of FIG. 1 in use to manually wrap pipe sealant thread about a pipe end.
Figure 11:
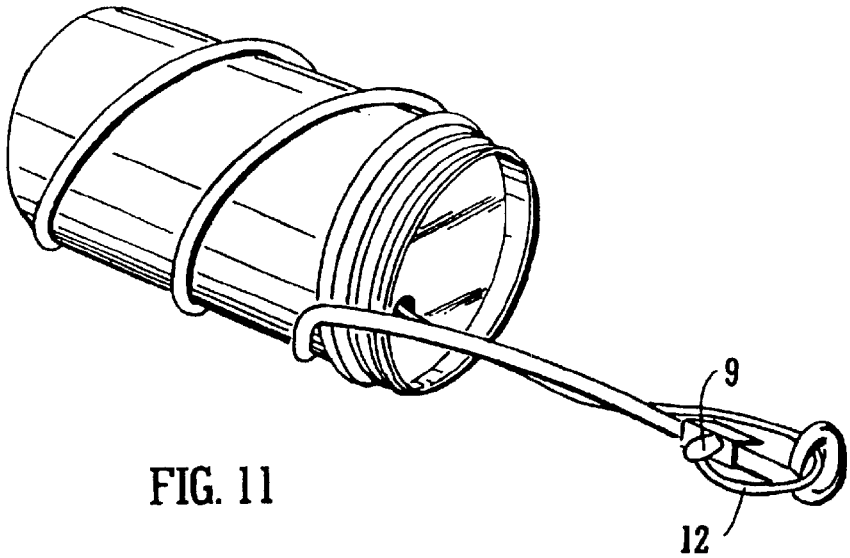
FIG. 11 is a perspective view of the device of FIG. 1 after the winding process of FIG. 10 has been completed and showing the cut-and-hold blade holding the filamentary material for the next use.

Winding of the filamentary material using the device of FIGS. 1 and 2 is shown in FIG. 10. The winding device 1 is shown being held a user's left hand 160, while a short length of pipe 161 is held in the right hand 162. The dispensing aid 7 together with the eye 8 guide the path of the yarn 12 onto the threads 163 of the pipe 162. The required number of wraps are applied. The cut-and-hold blade 9 is then used to snag and cut the yarn 12. As shown in FIG. 11 the yarn 12 is then held in the cut-and-hold blade 9 for the next use.

The projection of the dispensing aid from the retainer in each of the embodiments described above is particularly useful as it allows the pipe sealant material to be wound onto the pipe threads. At least part of the guide on the dispensing aid is arranged to project along part of the pipe (usually the threaded part) while the remainder of the device can be positioned forwardly of the end of the pipe. This means that the retainer and/or the hand holding it or the device operating it does not have to be brought alongside the pipe and can remain at a position forwardly of the pipe. This is useful when access to the pipe is awkward, for example when the pipe forms part of a plumbed system and the amount of room to work about the pipe is limited.

The path of the filamentary material is from a position forward of the end of the pipe to a position alongside the pipe threads. Generally the path of the filamentary material is from the retainer, along a line substantially parallel to the longitudinal axis of the pipe, to a position (within the guide) alongside the pipe. The material then exits the guide and turns radially inwardly (through about 90°) to wrap about the pipe. While the guide orbits the pipe about an axis substantially parallel to the longitudinal axis of the pipe, the filamentary material is applied, at a position along its path past the guide and usually at about 90° to the longitudinal axis of the pipe.

It will be appreciated that in all the embodiments described above the dispensing aid is arranged so that the point at which the filamentary material exits the guide, orbits or circles the pipe (with the guide) is alongside the pipe. In general the guide will remain spaced apart from the pipe on its travel.

For most purposes it is useful if the dispensing aid is of sufficient length to allow the guide to project alongside (at least part of) the threaded region of the pipe, while the retainer is positioned forwardly of the threaded end of the pipe. For these purposes it is useful if the dispensing aid projects proud of the retainer by about 0.5 cm to about 30 cm such as about 1.0 cm to about 20 cm for example from about 2.0 cm to about 18 cm, desirably about 4.0 cm to about 14.0 cm. Typically the guide is spaced from the retainer by similar distances.

It will be appreciated that the guide can be dimensioned to be a snug fit about the material it is guiding. For example the guide may be of a rectangular cross-section (particularly for tapes such as polytetrafluoroethylene tapes), circular cross-section (particularly for thread like material such as multifilament yarns) or any other desired cross-section. For dispensing the multifilament yarn of WO 98/47805 it is desirable that the guide has an aperture or opening of a circular cross-section. For good control of the material dispensed, it is desirable that the opening or eye of the guide is dimensioned to keep the movement of the material in check. For the multifilament yarn of WO 98/47805 the opening or eye may be non-angular (with no corners) for example substantially circular having a diameter in the range of about 0.05 cm to about 3.0 cm, though better control may be achieved with dimensions of about 0.1 cm to about 2.0 cm to, while for example a range of about 0.2 cm to about 1.0 cm should give strict control.

For most applications the elongate dispensing aid will have a width of no greater than about 6.0 cm, more usually not greater than about 4.0 cm. For dispensing the multifilament yarn of WO 98/47805 the dispensing aid desirably has a width of less than or equal to about 2.0 cm for example less than or equal to about 1.0 cm.

Generally, though particularly for the embodiments of FIGS. 3–9, the guide will be offset from the axis of the retainer. The offset value is determined by the size of pipe to which the material is to be applied. Typical offset values will be in the range of about 1.0 cm to about 20 cm, for example about 2.0 cm to about 8.0 cm and more typically about 2.5 cm to about 6.0 cm. These offset values are typical of the distance between the dispensing aid and the locating portion also.

It will also be appreciated that the devices of the invention could dispense the filamentary material rearwardly as they are moved along. The material for dispensing could be placed on a rotating spindle or turntable or such like.

The words "comprises/comprising" and the words "having/including" when used herein with reference to the present invention are used to specify the presence of stated features, integers, steps or components but does not preclude the presence or addition of one or more other features, integers, steps, components or groups thereof.

The invention having thus been described is defined in spirit and scope by the claims.

What is claimed is:

1. A device for winding filamentary materials for sealing threaded pipe joints onto a threaded pipe joint on an end of a pipe, comprising:

(a) a retainer for retaining a length of filamentary material; and (b) an elongate dispensing aid projecting from said retainer for guiding and dispensing the filamentary material through a path from the retainer onto the pipe joint, the dispensing aid comprising at least one guide located at a position spaced from the retainer and through which the filamentary material passes, the dispensing aid and the retainer being arranged so that in use for dispensing of the filamentary material the retainer may be located forwardly of the end of the pipe, wherein the filamentary material is a filamentary pipe sealant material comprising a filamentary material coated with a joint sealing material.

2. A device according to claim 1 for dispensing material onto pipe joints wherein a longitudinal axis of at least a portion of the dispensing aid is arranged to move about a longitudinal axis of a pipe at an angle to the longitudinal axis of the pipe of less than 90°.

3. A device according to claim 1 which is an attachment suitable for attaching to a container for the filamentary material.

4. A device according to claim 1 wherein the device forms an integral part of a container for the filamentary material.

5. A device according to claim 1 wherein the retainer is adapted to hold a container in which the filamentary material is located.

6. A device according to claim 1 wherein the filamentary material is wound about itself in the form of a coil.

7. A device according to claim 6 wherein the filamentary material is wound or looped upon itself in a single direction, so that each wind or loop is generally located about a central axis.

8. A device according to claim 1 wherein the filament guide is offset from the centre of the device allowing the filamentary material to be dispensed in a circular manner by movement of the device.

9. A device according to claim 1 wherein the guide comprises at least one opening or eye through which the filamentary material passes.

10. A device according to claim 1 wherein the dispensing aid has a hollow portion through which the filamentary material passes, and the guide is formed by a mouth at the end of the hollow portion, the mouth being spaced from the retainer.

11. A device according to claim 1 wherein a cut-and-hold blade is provided on the dispensing aid for cutting the filamentary material at a suitable place and holding the filamentary material for the next use.

12. A device according to claim 11 wherein the blade is located on or close to the guide.

13. A device according to claim 11 wherein the blade is integrally formed with the dispensing aid.

14. A device according to claim 11 wherein the blade is positioned on the dispensing aid between the retainer and a free end of the dispensing aid.

15. A device according to claim 11 wherein the blade is located on the dispensing end of the dispensing aid.

16. A device according to claim 1 wherein the dispensing aid comprises an elongate body with a channel defined therein along a longitudinal axis and the guide is formed by a mouth at the end of the channel.

17. A device according to claim 1 wherein the guide is located at an off-centre position on the device, offset from a coil axis of the coiled filamentary material, so that the filamentary material may be wound about the pipe.

18. A device according to claim 1 wherein the dispensing aid is mounted for rotational motion on the retainer.

19. A device according to claim 1 further comprising a locating portion which extends from the retainer in the same general direction as the dispersing aid for engaging an end of pipe to which the filamentary material is to be applied.

20. A device according to claim 19 wherein the locating portion engages an internal portion of the pipe to be joined.

21. A device according to claim 20 wherein the locating portion is tapered to allow snug fitting within pipe bores of different internal dimensions.

22. A device according to claim 19 wherein the locating portion engages an exterior portion of the pipe.

23. A device according to claim 22 wherein the locating portion is a hood or cowl which is dimensioned to receive the pipe.

24. A device according to claim 23 wherein the locating portion is adjustable so as to allow positioning of the guide at different positions relative to the pipe.

25. A device according to claim 24 wherein the locating portion is arranged for biased movement.

26. A device according to claim 24 wherein the winding device further comprises an automatic adjuster for regulating the position of the dispensing aid relative to a pipe to which the filamentary material is to be applied.

27. A device according to claim 26 wherein the locating portion also acts as the automatic adjuster.

28. A device according to claim 26 wherein relative rotation of the dispensing aid and the automatic adjuster, actuates the automatic adjuster.

29. A device according to claim 26 wherein relative rotation of the dispensing aid and the automatic adjuster, actuates the automatic adjuster.

* * * * *

UNITED STATES PATENT AND TRADEMARK OFFICE

CERTIFICATE OF CORRECTION

PATENT NO. : 6,547,177 B2
DATED : April 15, 2003
INVENTOR(S) : Martin J. Fitzpatrick It is certified that error appears in the above-identified patent and that said Letters Patent is hereby corrected as shown below:

Column 14,
Line 16, should read -- ...the dispensing aid… --.
Lines 43-45, claim 29 should be eliminated.

Signed and Sealed this

Twenty-seventh Day of January, 2004

JON W. DUDAS
*Acting Director of the United States Patent and Trademark Office*